US005573422A

United States Patent [19]

Lawliss

[11] Patent Number: 5,573,422

[45] Date of Patent: Nov. 12, 1996

[54] ELECTRICAL CORD RETAINING AND PROTECTION SYSTEM

[75] Inventor: Ryan Lawliss, Cathedral City, Calif.

[73] Assignee: Ryan J. Lawliss, Cathedral City, Calif.

[21] Appl. No.: 517,066

[22] Filed: Aug. 21, 1995

[51] Int. Cl.[6] ..... H01R 13/56

[52] U.S. Cl. ..... 439/448; 439/445

[58] Field of Search ..... 439/448, 447, 439/445

[56] References Cited

U.S. PATENT DOCUMENTS

| | | | |
|---|---|---|---|
| 1,297,608 | 3/1919 | Tidball | 439/448 |
| 3,068,316 | 12/1962 | Witt | 174/135 |
| 3,097,034 | 7/1963 | Jamrosy | 339/75 |
| 3,397,279 | 8/1968 | Paullus et al. | 439/448 |
| 3,611,265 | 10/1971 | Shurtz | 339/103 |
| 3,871,731 | 3/1975 | LaCoursiere, Sr. et al. | 339/75 P |
| 3,922,055 | 11/1975 | McGregor | 339/105 |
| 4,149,765 | 4/1979 | Mortelmans | 339/58 |
| 4,206,961 | 6/1980 | Cifalde | 339/75 P |
| 4,875,879 | 10/1989 | Bunyea et al. | 439/501 |

*Primary Examiner*—Gary F. Paumen

*Attorney, Agent, or Firm*—Info Tech; Kevin Ablbeck

[57] ABSTRACT

A cord retaining system as disclosed. The invention supports the cord of power tools or other electrical appliances by wrapping the cord around an elongated curved section of the invention and securing it from moving by pressing it in a coil with a restricted opening thereby clamping it thereto. The curved section of the invention directs the cord, whether it be the cord of the tool or an extension cord to electrically connect the tool to the power source, away from the area of the work area of the tool. The invention is especially useful with tools such as a power saw where the electrical cord could easily get in the way of the blade and be damaged or severed by the rotating blade. The result would not only damage or destroy the cord but a live open electrical cord could prove dangerous or even potentially fatal to a person nearby or the user's hand if he tries to grab the cord out of the way of the rotating blade. The invention greatly reduces the likelihood of such an accident by moving the cord away from the proximity of the blade.

14 Claims, 4 Drawing Sheets

ELECTRICAL CORD RETAINING AND PROTECTION SYSTEM

BACKGROUND OF THE INVENTION

1. Field of the Invention

The invention herein relates to a system of protecting an electrical cord from damage, and more particularly to a system of protecting the electrical cord of an electrical power tool from damage which can be encountered by the function of the tool itself, such as being cut by the blade of a power saw.

2. Overview of Prior Art

It is a common occurrence that accidents happen in the area of damaging the cords of power tools, especially power saws. The necessity of the cord in close proximity to the workings of the tool predispose the combination to damage and danger. It is unfortunate that little has been done in an attempt to correct this problem.

Shurtz in U.S. Pat. No. 3,611,265 discloses a spring holder with an enlarged loop on one end thereof. The spring holder surrounds the cord and places the cord in tension from the tool housing to the plug. This tensioning force causes the cord to be directed away from the tool. The obvious limitations include if the length of the cord on the tool is to great the function of the coil in this manner is virtually useless. Secondly, the spring end that is in contact with the tool housing will attempt to fit flat up against that surface and extend the cord perpendicular to that surface, keeping in mind that the weight of the cord will cause it to fall as it extends away from the tool. If the surface is at an angle that positions the cord in a downward direction the combination of this and the cord weight will put the cord directly on the workpiece, even if the cord is of the proper length to make the device potentially functional. The result is a very limited potential for the product to be effective.

In U.S. Pat. No. 4,149,765 to Mortelmans, a system of storage of a coiled electrical cord on an appliance is disclosed. In this the primary purpose is in the interest of space saving and convenience of the user in that the cord is automatically stored inside the housing of the appliance such as a vacuum cleaner. If the device was incorporated on a power tool the results would be of minimal consequence in that the cord still freely extends out of the appliance.

Similarly, Witt discloses in U.S. Pat. No. 3,068,316 a cord shortening holder which is comprised of a self contained unit that coils surplus lengths of electrical cord. The unit is not obvious in its connection to a power tool housing and if it was how it would prevent the cord from coming into contact with the functional element of the power tool. Therefore the problems disclosed herein are not adequately addressed by this device.

More common are locking devices that are intended to prevent inadvertent disconnection of the cord from an electrical appliance or tool. Bunyea et al., in U.S. Pat. No. 4,875,879 discloses a cord retainer for a power tool such as a trimmer or drill. This includes a cam that contacts the cord which is captured on the opposite side, thus securing the cord's position in relation to the handle of the tool. The cord still extends directly out of the tool's handle thus doing little to prevent accidental contact of the cord and the cutting edge of the tool.

LaCoursiere, Sr. et al. discloses a cage tier enclosing electrical cords in U.S. Pat. No. 3,871,731. This is limited to securing a plug into a wall socket or tow adjacent mating ends of a pair of cords. This provides no system of keeping the cord from the work area of a tool.

The following three U.S. Pat. Nos.: 4,206,961; 3,922,055 and 3,097,034 disclosed by Cifalde, McGregor and Jamrosy respectively all disclose methods of preventing unwanted disconnection of mating plug ends of adjacent electrical cords. In each case the application would not be anticipated in an application to somehow prevent the cord from coming in contact with the workings of a tool. The devices are all restricted to a spring or coil that applies a frictional force to the cords thereby preventing them from pulling away from each other when they are plugged in one to another. None of the disclosed art adequately addresses the problem of preventing contact of the cord with the working area of power tools.

SUMMARY OF THE INVENTION

The object of the disclosed invention is to provide a means of protecting an electrical power cord from the workings of a power tool to which the cord is attached. It is easy to imagine a power tool such as an electric saw cutting an object and the cord, which is used to power the saw, gets in the way of the saw blade. The operator of the saw is commonly concentrating on the object he is working on and could easily allow the cord to inadvertently get in the way. The results could be disastrous. If the blade cuts through the cord not only is the cord destroyed but the resulting live electrical wire has the potential to come into contact with someone or something, causing electrical burns or even death. In addition the invention eliminates the need to place the user's hand next to the blade. When the cord gets close to the blade the user generally grabs the cord to pull it away from the blade, placing the hand in danger of contact with the rotating blade.

The disclosed invention is a resilient extension that bolts onto the base of a tool or is manufactured as a part of the tool, and has an extension or rod like member around which the power cord is coiled. Two designs are disclosed, one in which the invention includes a series of coils thereby containing the cord and a second design in which the rod like member is substantially straight and the cord is wound around the rod. Both designs include a gentile curve to the rod to direct the cord away from the tool and a tight coil at the distal end which acts as a clamp to secure the cord to the invention.

DETAILED DESCRIPTION OF THE PREFERRED EMBODIMENT

Figure 1:
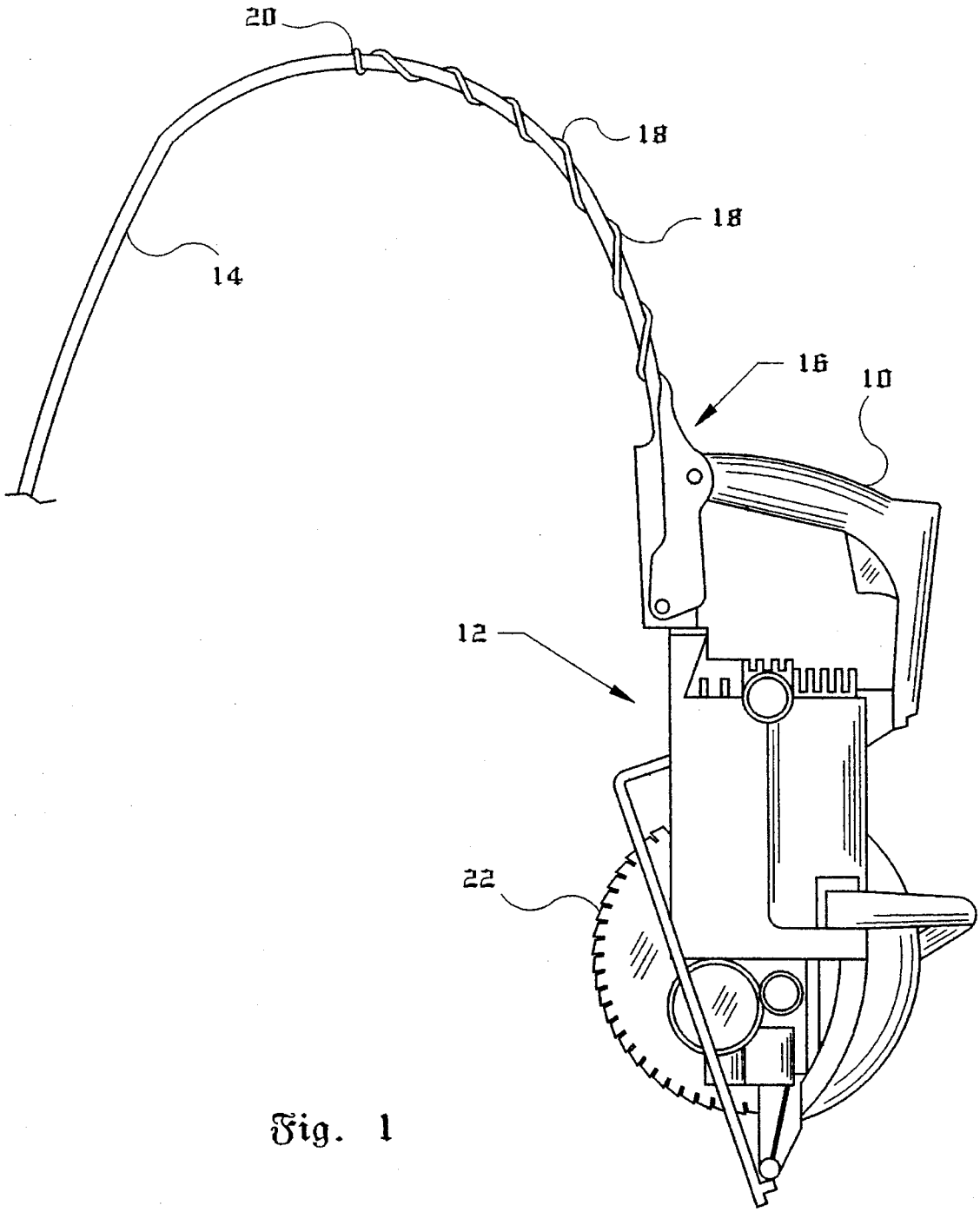
FIG. 1 is a side view of a power tool, comprising a power saw, utilizing the cord retaining system produced in accordance with the preferred embodiment of the present invention.

Referring to the drawings, a device constructed in accordance with the present invention is shown in FIG. 1, whereby the invention is shown in its traditional application of being fastened to the handle 10 of a power tool such as a power saw 12. The necessity of keeping the cord 14 away from the saw 12 is accomplished by a resilient elongated device that displaces the cord 14 by wrapping the cord 14 around the elongated portion and securing it to same. The cord retainer 16 in this case is shown as comprising of a series of turns or coils 18. On the distal end thereof is a clamp 20 which is comprised of a single open coil. The cord 14 extending from the saw 12 is wrapped between the coils 18 and finally through the clamp 20 until the cord 14 is contained within the invention thereby displacing the cord 14 away from the saw 12 and especially the saw blade 22.

Figure 2:
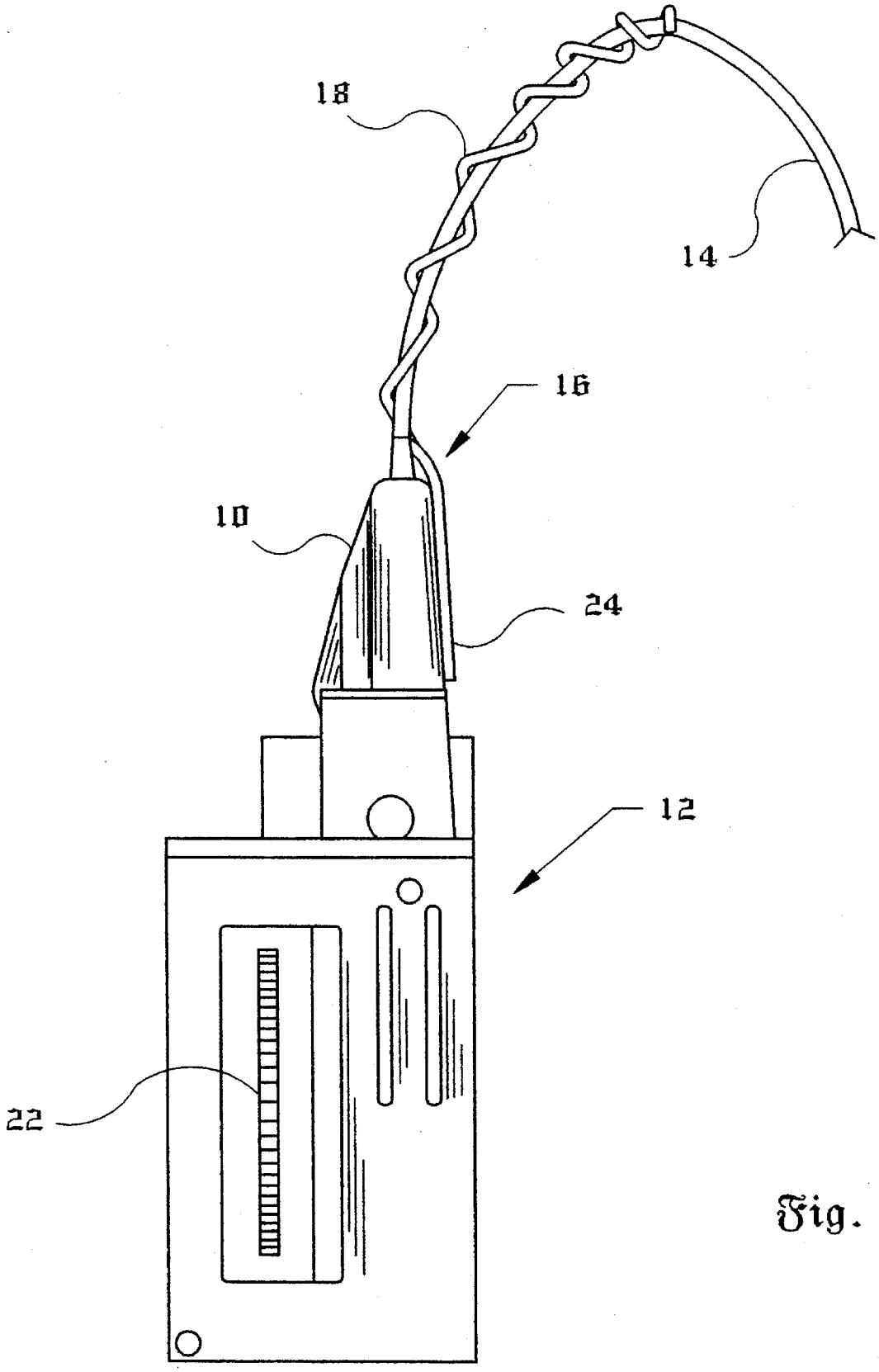
FIG. 2 is a bottom view of a power tool, comprising the power saw shown in FIG. 1, utilizing the cord retaining system produced in accordance with the preferred embodiment of the present invention.

In FIG. 2 a bottom view of the power saw 12 shown in FIG. 1 is shown depicting the cord retainer 16 fastened to the handle 10. In this view the coils 18 extending from the base plate 24 are shown to curve to the right thereby displacing the cord 14 not only to the rear of the saw 12, away from the blade 22 but also to the right. This further displaces the cord 14 away from the blade 22 by directing it across the body of the user and completely away from the item being cut by the saw.

Figure 3:
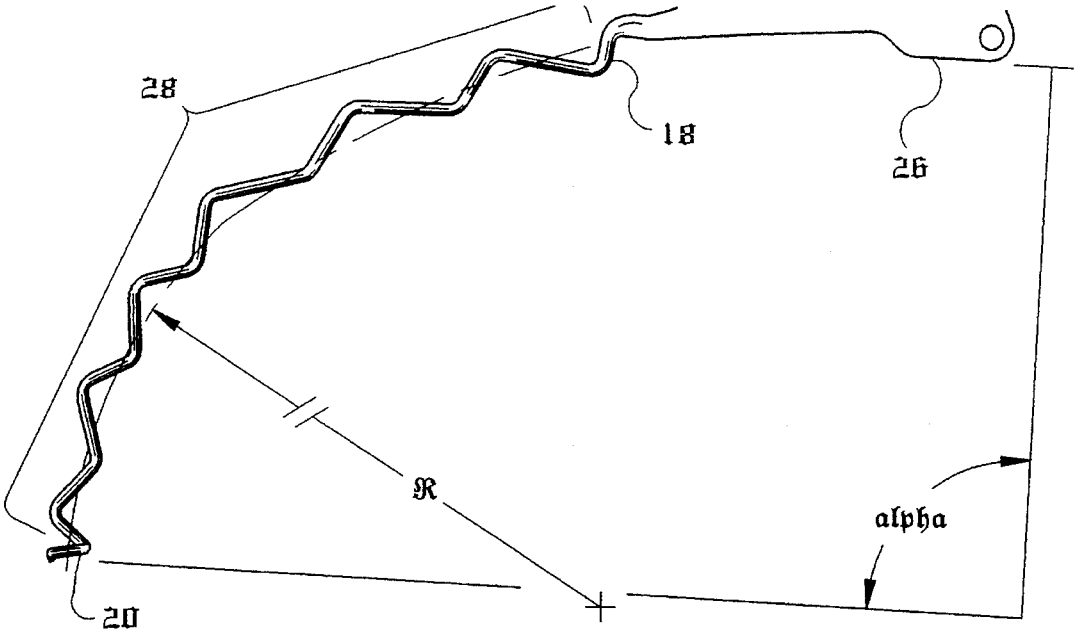
FIG. 3 is a side view of a coiled cord retaining system produced in accordance with the preferred embodiment of the present invention.

With reference now to FIG. 3, the cord retainer 16 is shown with the series of turns 18 and the clamp 20 on the distal end thereof in which the invention is shown alone. The invention is comprised of a series of these turns 18 resulting in a coil which is bent along a curvilinear axis so that when the cord is enclosed therein the invention directs the cord to the side and away from the base plate 24 which is attached to the tool being used. Here the centerline radius (R) is shown as what has been determined to be an optimal of approximately 9 inches. This value is not critical to the operation of the invention and a variety of dimensions would function adequately ranging from 36 inches to 3–4 inches. The angle (alpha) is also a non critical value but through the inventor's experimentation an optimal value of 90 degrees was determined from the flat edge 26 of the base plate 24 to the end of the clamp 20.

The material of which the device is constructed is comprised of some resilient material such that the coiled section 28 retains its spiral coils 18 providing a curvilinear void space that is capable of receiving an electrical power cord therein. The device must be able to resist normal damage from wear and tare associated with the use of power tools. The most desirable materials have been found to be UV resistant thermoplastics such as nylon, polyvinyl chloride (PVC), polycarbonate or polyurethane, though these materials are not necessary to the function of the invention.

Figure 4:
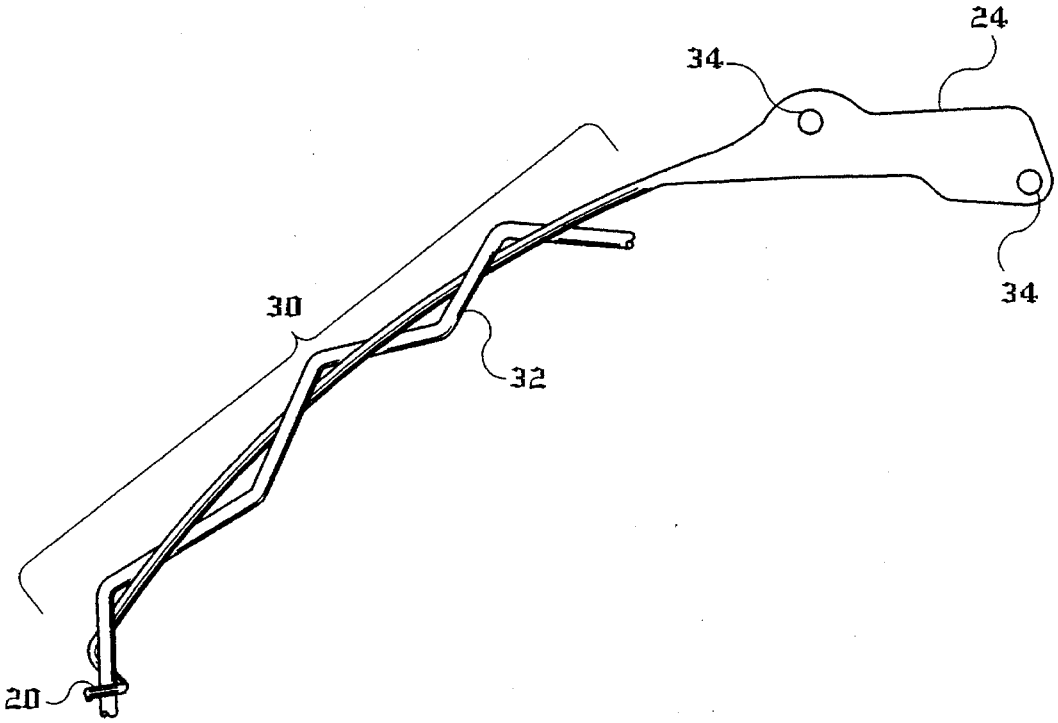
FIG. 4 is a side view of a non-coiled cord retaining system produced in accordance with the preferred embodiment of the present invention.

The invention can also be utilized by eliminating the coils as shown in FIG. 4. The same curvilinear section as shown in FIG. 3 with the exception that the flat curve 30 of FIG. 4 replaces the coiled section 28 in FIG. 3. The base plate 24 and the clamp 20 also serve the same purpose as in the earlier described version of the invention. The flat curve 30 also follows a similar radius to support an electrical power cord 32 by wrapping the cord around the flat curve 30 and then secured within the clamp 20 as further depicted in FIG. 4.

With either design the base plate 24 can be secured to the tool by a variety of means from holes 34 through which fasteners then secure the invention to the handle of the tool or a variety of clamping means whether a spring loaded mechanical clamp, steel plate in the base plate 24 and a magnet secured to the tool handle or an adhesive to secure the base plate 24 to the handle, or even nylon or plastic straps to secure the plate to the handle. Either way, the function of the invention is unchanged.

Figure 5:
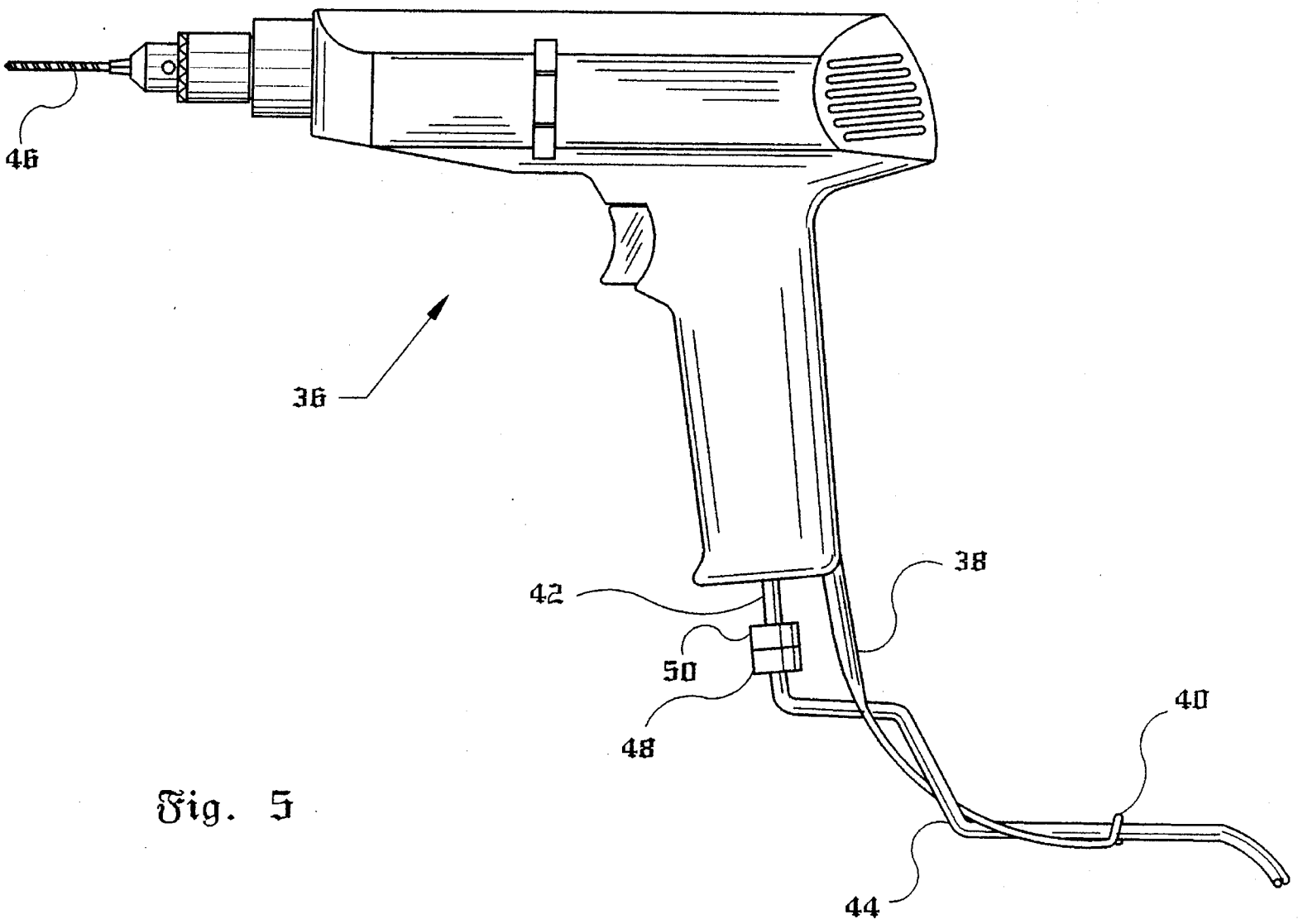
FIG. 5 is a side view of an electric drill utilizing a cord retaining system as it is continuous with the housing of the tool and produced in accordance with the preferred embodiment of the present invention.

Another alternative form of the invention is shown in FIG. 5. In this the an electric drill 36 is shown as the power tool and the cord retainer 38 is a curved section that is continuous with the housing of the drill 36. The cord retainer 38, being constant with the previously disclosed versions of the invention, also includes a clamp 40 at the distal end thereof. Another definite advantage to the invention as seen by a prospective manufacturer is shown here in that the length of the tool cord 42 can be greatly shortened thereby saving manufacturing costs to offset the cost of the addition of the invention. This is conceivable because the user can utilize an extension cord 44, which is commonly used anyway, wrap it around the cord retainer 38 being secured in place by it being pushed into the clamp 40 thus not only moving the cord 44 away from the way of the moving bit 46 in the drill but by securing the cord within the clamp 40 the female plug 48 of the cord 44 and the male plug 50 of the tool cord 42 are much less likely to inadvertently be disconnected during the use of the tool 36.

What is claimed is:

1. A cord retaining system for securing a section of electrical cord of a given diameter, adjacent to and extending from an electric power tool, the power tool including an electric motor, the system comprising:

a substantially flat, longitudinal base plate providing a first end and a second end and providing a means of attachment to at least one side of a power tool;

a rigid rod-like member forming an elongated coil with a plurality of turns with an internal bend diameter greater than the given diameter of the electrical cord, the turns formed around at least one curvilinear central axis, the member providing a first end and a second end, wherein the pitch of the turns are greater than the sum of the given diameter of the electrical cord plus the diameter of the rod-like member and the first end being continuous with the second end of said base plate; and a clamp on the second end thereof, the clamp comprising a segment of a single coil in which the pitch and the bend diameter are less than the remainder of the coils, whereby said base plate can be mounted to the handle of the power tool and the electrical cord extending therefrom passes through said coils, being contained therein, and is secured to the power tool by said clamp, thereby extending said cord away from the tool and preventing interference between the cord and the tool.

2. The cord retaining system as described in claim 1, wherein said means of attachment is comprised of a plurality of holes in said base plate receiving by a plurality of fasteners, whereby said base plate can be fastened to the handle of a power tool through holes provided therein.

3. The cord retaining system as described in claim 1, wherein said curvilinear central axis is an axis of a radius of approximately 7 to 10 inches and the axis is not coplanar with said base plate.

4. The cord retaining system as described in claim 1, wherein said plurality of turns around said curvilinear central axis has an axial arc length of approximately 5 to 18 inches.

5. The cord retaining system as described in claim 1, wherein said base plate, said elongated coil and said clamp are comprised of a rigid material.

6. The cord retaining system as described in claim 5, wherein said rigid material is comprised of a thermoplastic material.

7. The cord retaining system as described in claim 6, wherein said thermoplastic material is a material selected from the group consisting of nylon, polyvinyl chloride, polycarbonate and polyurethane.

8. A cord retaining system for securing a section of electrical cord of a given diameter, adjacent to and extending from an electric power tool, the power tool including an electric motor, the system comprising:

a substantially flat, longitudinal base plate providing a first end and a second end and providing a means of attachment to at least one side of a power tool;

a rigid rod-like member with at least one curvilinear axis, the member providing a first end and a second end, wherein the first end is continuous with the second end of said base plate; and a clamp on the second end of said rod-like member, the clamp comprising a segment of a single coil in which the internal bend diameter is slightly greater than the given diameter of said electrical cord, whereby said base plate can be mounted to the handle of the power tool and the electrical cord extending therefrom wraps around said rod-like member, passes through said clamp, being contained therein, and is secured to the power tool by said clamp, thereby extending said cord away from the tool and preventing interference between the cord and the tool.

9. The cord retaining system as described in claim 8, wherein said means of attachment is comprised of a plurality of holes in said base plate receiving by a plurality of fasteners, whereby said base plate can be fastened to the handle of a power tool through holes provided therein.

10. The cord retaining system as described in claim 8, wherein said curvilinear axis is an axis of a radius of approximately 7 to 10 inches and the axis is not coplanar with said base plate.

11. The cord retaining system as described in claim 8, wherein said curvilinear axis has an arc length of approximately 9 to 12 inches.

12. The cord retaining system as described in claim 8, wherein said base plate, said rod-like member and said clamp are comprised of a rigid material.

13. The cord retaining system as described in claim 12, wherein said rigid material is comprised of a thermoplastic material.

14. The cord retaining system as described in claim 13, wherein said thermoplastic material is a material selected from the group consisting of nylon, polyvinyl chloride, polycarbonate and polyurethane.

* * * * *